US005736308A

United States Patent [19]

Schmuck et al.

[11] Patent Number: 5,736,308

[45] Date of Patent: Apr. 7, 1998

[54] COLOR PHOTOGRAPHIC SILVER HALIDE MATERIAL

[75] Inventors: Arno Schmuck, Leichlingen; Jörg Hagemann, Köln, both of Germany

[73] Assignee: Agfa-Gevaert AG, Germany

[21] Appl. No.: 831,293

[22] Filed: Apr. 1, 1997

[30] Foreign Application Priority Data

Apr. 9, 1996 [DE] Germany ..... 196 13 992.9

[51] Int. Cl.[6] ..... G03C 1/835

[52] U.S. Cl. ..... 430/512; 430/530; 430/950

[58] Field of Search ..... 430/512, 530, 430/950

[56] References Cited

U.S. PATENT DOCUMENTS

| | | | |
|---|---|---|---|
| 4,563,406 | 1/1986 | Ohbayashi et al. | 430/513 |
| 5,075,206 | 12/1991 | Noda et al. | 430/531 |
| 5,547,823 | 8/1996 | Murasawa et al. | 430/950 |

FOREIGN PATENT DOCUMENTS

| | | |
|---|---|---|
| 9454833 | 8/1994 | Australia . |
| 0 609 533 | 8/1994 | European Pat. Off. . |
| 736800 | 10/1996 | European Pat. Off. . |
| 43 02 896 | 8/1994 | Germany . |
| 19511316 | 10/1996 | Germany . |
| 272041 | 10/1996 | Japan . |

OTHER PUBLICATIONS

Industrial Inorganic Pigments, Gunter Buxbaum, Weinheim, New York, pp. 227–228.

U.S. Serial No. 08/618.208.

*Primary Examiner*—Hoa Van Le
*Attorney, Agent, or Firm*—Connolly & Hutz

[57] ABSTRACT

$TiO_2$ containing iron oxide having an average primary particle diameter of 1 to 100 nm and an iron oxide content of 0.5 to 20 wt. % is suitable as a UV absorber for photographic materials.

12 Claims, No Drawings

COLOR PHOTOGRAPHIC SILVER HALIDE MATERIAL

Colour photographic materials always contain UV absorbers in order to improve or maintain the light stability of the image dyes present in the material after processing. High UV daylight can bleach the image dyes.

The compounds conventionally used in photographic materials to absorb UV light are, for example, aryl-substituted benzotriazole compounds (U.S. Pat. No. 3,533,794, DE 42 29 233), 4-thiazolidone compounds (U.S. Pat. No. 3,314,794, U.S. Pat. No. 3,352,681), benzophenone compounds (JP-A-2784/71), cinnamic acid esters (U.S. Pat. No. 3,705,805, U.S. Pat. No. 3,707,375), butadiene compounds (U.S. Pat. No. 4,045,229), benzoxazole compounds (U.S. Pat. No. 3,700,455), aryl-substituted triazine compounds (DE 21 13 833, EP 520 938, EP 530 135, EP 531 258) and benzoylthiophene compounds (GB 973 919, EP 521 823). UV absorbing couplers or polymers, which may be immobilised in a specific layer by mordanting, are also used.

One disadvantage of these organic compounds is that they are themselves light stable only to a limited extent. Once the UV absorbing compounds have been destroyed by light, the image dyes begin to bleach.

This disadvantage may be overcome by using $TiO_2$ pigments having an average primary particle diameter of 1 to 100 nm, preferably of 5 to 50 nm. These $TiO_2$ pigments are transparent and, unlike conventional $TiO_2$-based white pigments (rutile and anatase) with an optimum particle size of approximately 0.2 μm, they have virtually no light-scattering characteristics. They are moreover colourless. Transparent $TiO_2$ in rutile form is particularly advantageous as a UV absorber for photographic material.

The $TiO_2$ pigments according to the invention are particularly advantageous where more than 90% of the primary particles have a diameter of less than 100 nm.

Transparent $TiO_2$ pigments having the stated characteristics are known, for example, from Gunter Buxbaum, Industrial Inorganic Pigments, VCH Weinheim, New York, Basel, Cambridge, Tokyo (1993), pages 227 to 228.

However, these $TiO_2$ pigments have the disadvantage of having low absorbance in the long-wave UV range, i.e. at a wavelength of 320 to 400 nm, such that large quantifies must be applied to ensure adequate UV protection.

It is now known from DE 43 02 896 that $TiO_2$ pigments containing iron oxide have an overall higher absorbance in the UV range than corresponding $TiO_2$ pigments containing no iron oxide.

It has now been found that $TiO_2$ pigments containing iron oxide having an average primary particle diameter of 1 to 100 nm, preferably of 5 to 50 nm and an iron oxide content of 0.01 to 20 wt. %, preferably of 0.05 to 10 wt. %, particularly preferably of 0.5 to 5 wt. % are suitable as UV absorbers for photographic material, preferably colour photographic material.

$Fe_2O_3$ may primarily be considered as the iron oxide. $TiO_2$ of rutile structure is preferably used.

The $TiO_2$ pigments containing iron oxide according to the invention are preferably coated on the surface with $SiO_2$ or $Al_2O_3$.

The $TiO_2$ pigments containing iron oxide according to the invention are preferably used in the colour photographic material in a layer which is situated no further from the light source than the layer in which the dye formed by development to be protected from UV light is located.

The $TiO_2$ pigments containing iron oxide according to the invention are preferably used in a layer which is arranged closer to the light source than the layer containing the dye to be protected.

The $TiO_2$ pigments containing iron oxide according to the invention are in particular used in a quantity of 5 mg to 5 g/m$^2$, preferably of 100 mg to 3 g/m$^2$ of photographic material.

It is particularly advantageous for the $TiO_2$ pigments containing iron oxide according to the invention to be dispersed in a gelatine solution so that they may be cast into a layer. In this manner, a considerably thinner layer is achieved than with customary UV absorbers, which are conventionally distributed in high-boiling organic solvents and must thus be emulsified as fine droplets in a gelatine solution.

The $TiO_2$ pigments containing iron oxide according to the invention impart enduring protection against UV light to the dyes of the photographic image obtained after colour development because, unlike organic UV absorbers, they are not destroyed by UV light.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in Research Disclosure 37254, part 1 (1995), page 285.

The $TiO_2$ pigments containing iron oxide according to the invention are preferably added to colour photographic print materials, i.e. colour photographic paper and transparent photographic film for display purposes.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products: Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers which prevents blue light from reaching the underlying layers.

Possible options for different layer arrangements and the effects thereof on photographic properties are described in J. Inf. Rec. Mats., 1994, volume 22, pages 183–193.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 2 530 645).

The substantial constituents of the photographic emulsion layers are binder, silver halide grains and colour couplers.

Details of suitable binders may be found in Research Disclosure 37254, part 2 (1995), page 286.

Details of suitable silver halide emulsions, the production, ripening, stabilisation and spectral sensitisation thereof, including suitable spectral sensitisers, may be found in Research Disclosure 37254, part 3 (1995), page 286 and in Research Disclosure 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 mol. % of AgBr or silver chloride-bromide emulsions with above 95 mol. % of AgCl.

Details relating to colour couplers may be found in Research Disclosure 37254, part 4 (1995), page 288 and in Research Disclosure 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which; on reaction with the developer oxidation product, release photographically active compounds, for example DIR couplers which eliminate a development inhibitor.

Details relating to such compounds, in particular couplers, may be found in Research Disclosure 37254, part 5 (1995), page 290 and in Research Disclosure 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 μm in diameter) in the layers. Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally located between layers of different spectral sensitivity may contain agents which prevent an undesirable diffusion of developer oxidation products from one photosensitive layer into another photo-sensitive layer with a different spectral sensitisation.

Suitable compounds (white couplers, scavengers or DOP scavengers) may be found in Research Disclosure 37254, part 7 (1995), page 292 and in Research Disclosure 37038, part III (1995), page 84.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in Research Disclosure 37254, part 8 (1995), page 292 and in Research Disclosure 37038, parts IV, V, VI, VII, X, XI and XIII (1995), pages 84 et seq..

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294 and in Research Disclosure 37038, part XII (1995), page 86.

Once exposed with an image, colour photographic materials are processed using different processes depending upon their nature. Details relating to processing methods and the necessary chemicals are disclosed in Research Disclosure 37254, part 10 (1995), page 294 and in Research Disclosure 37038, parts XVI to XXIII (1995), pages 95 et seq. together with example materials.

EXAMPLE 1

Sample 1

A colour photographic recording material was produced by applying the following layers in the stated sequence onto a film support of paper coated on both sides with polyethylene. Quantifies are stated per 1 $m^2$. The applied quantity of silver halide is stated as the corresponding quantity of $AgNO_3$.

1st layer (substrate layer):
- 0.1 g of gelatine

2nd layer (blue-sensitive layer):
- Blue-sensitive silver halide emulsion (99.5 mol. % chloride, 0.5 mol. % bromide, average grain diameter 0.9 μm) prepared from 0.40 g of $AgNO_3$with
  - 1.25 g of gelatine
  - 0.30 g of yellow coupler GB 1
  - 0.20 g of yellow coupler GB 2
  - 0.50 g of tricresyl phosphate (TCP)
  - 0.10 g of stabiliser ST-1
  - 0.30 mg of stabiliser ST-2
  - 0.70 mg of sensitiser S-1

3rd layer (interlayer):
- 1.1 g of gelatine
- 0.06 g of oxform scavenger O-1
- 0.06 g of oxform scavenger O-2
- 0.12 g of TCP 4th layer (green-sensitive layer)
- Green-sensitised silver halide emulsion (99.5 mol. % chloride, 0.5 mol. % bromide, average grain diameter 0.47 μm) prepared from 0.25 g of $AgNO_3$ with
  - 0.77 g of gelatine
  - 0.22 g of magenta coupler PP 1
  - 0.30 g of stabiliser ST-3
  - 0.50 mg of stabiliser ST-4
  - 0.20 g of diisooctyl phthalate
  - 0.20 g of dibutyl phthalate
  - 0.70 mg of sensitiser S-2

5th layer (UV protective layer)
- 1.15 g of gelatine
- 0.30 g of UV absorber UV-1
- 0.10 g of UV absorber UV-2
- 0.06 g of O-1
- 0.06 g of O-2
- 0.35 g of diisononyl adipate 6th layer (red-sensitive layer)
- Red-sensitised silver halide emulsion (99.5 mol. % chloride, 0.5 mol. % bromide, average grain diameter 0.50 μm) prepared from 0.25 g of $AgNO_3$ with
  - 1.00 g of gelatine
  - 0.46 g of cyan coupler BG 1
  - 0.46 g of TCP 0.60 mg of stabiliser ST-5
0.03 mg of sensitiser S-3
7th layer (UV protective layer)
0.35 g of gelatine
0.15 g of UV 1
0.03 g of UV-2
0.09 g of TCP
8th layer (protective layer)
0.9 g of gelatine
0.3 g of hardener H 1
0.05 g of optical brightener W-1
0.07 g of polyvinylpyrrolidone
1.2 mg of silicone oil
2.5 mg of polymethyl methacrylate spacers
GB1
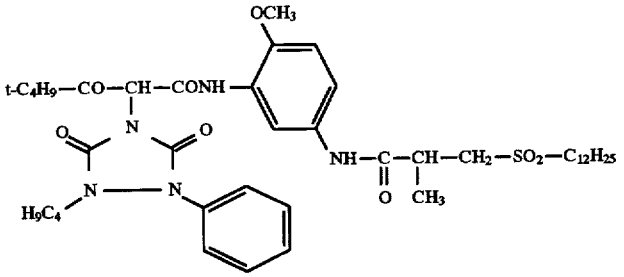
GB2
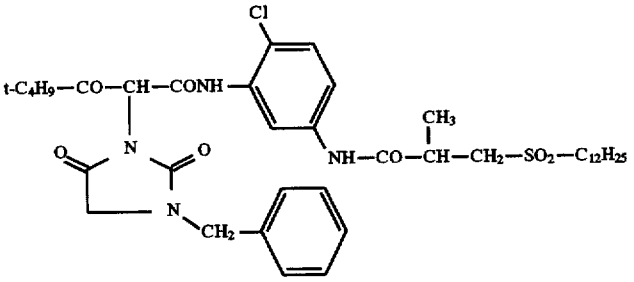
PP1
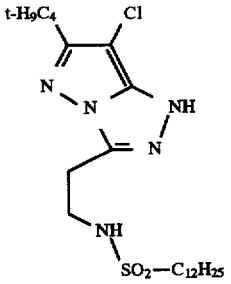
BG1
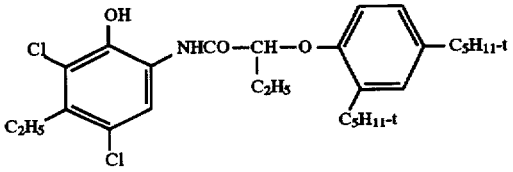
UV1
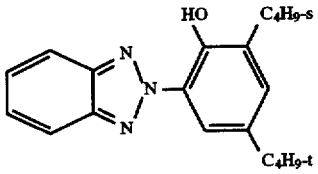
UV2
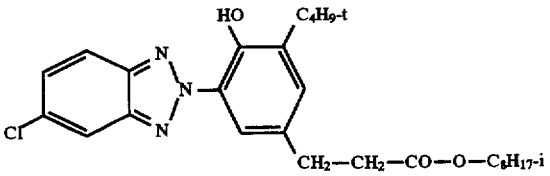

-continued
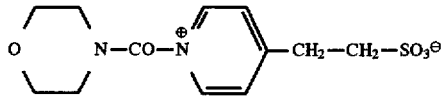
H1
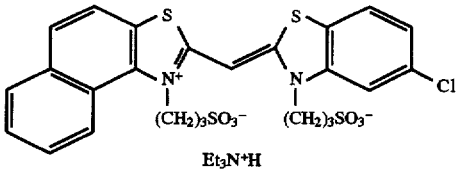
S-1
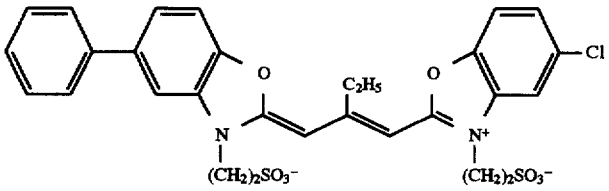
S-2
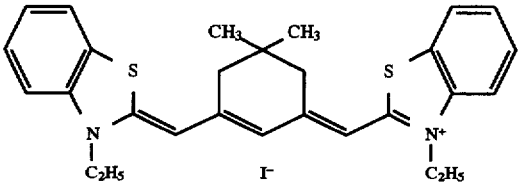
S-3
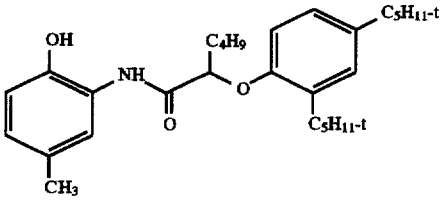
St-1
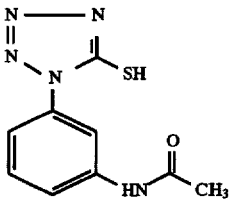
St-2
2:1-mixture of
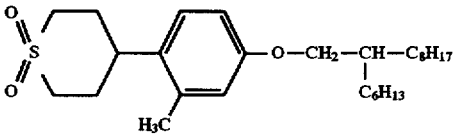
ST-3
and
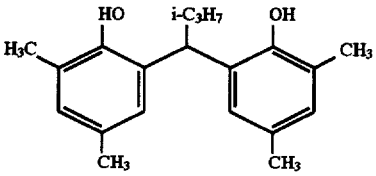
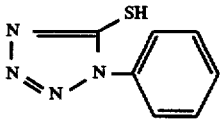
ST-4

-continued

ST-5

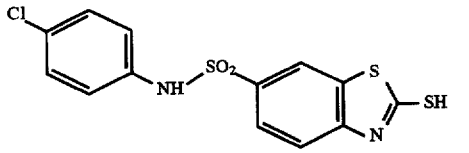

O-1

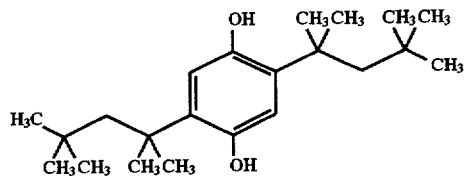

O-2

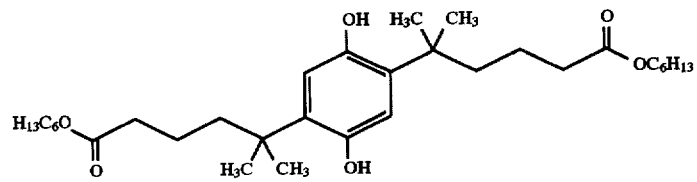

W-1

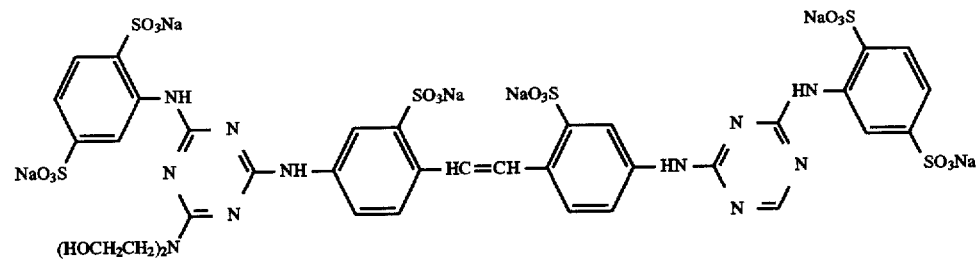

Samples 2 to 4

There are the following differnce with respect to sample 1:

a) UV-1 and UV-2 are omitted from the 5th layer b) The 7th layer has the following composition:

0.30 g of gelatine and, in specimen 2, 0.60 g of $TiO_2$ (antase, particle size approx. 30 nm, density 3.8 g/cm$^3$ and, in samples 3 and 4, 0.35 and 0.55 g respectively of $TiO_2$ containing iron oxide (3 wt. % $Fe_2O_3$; particle size 30 nm) according to DE 43 02 896. The $TiO_2$ of sample 3 has an anatase structure and that of sample 4 a rutile structure. The $TiO_2$ of samples 2 to 4 is coated with 3 wt. % of $Al_2O_3$, relative to $TiO_2$ plus $Fe_2O_3$.

The colour photographic recording materials are exposed through a step wedge. On exposure, additional filters are placed in the beam path of the exposure unit such that the wedge appears neutral at an optical density of D=0.6. The material is additionally exposed through a step wedge, once with a filter which transmits red light, once with a filter which transmits green light and once with a filter which transmits blue light, such that cyan, magenta and yellow colour separations are obtained. The exposed material is processed using the following method:

| Stage | Time | Temperature |
|---|---|---|
| Development | 45 s | 35° C. |
| Bleach/fixing | 45 s | 35° C. |
| Rinsing | 90 s | 33° C. |

The processing baths were prepared in accordance with the following instructions:

Colour Developer Solution

| | |
|---|---|
| Tetraethylene glycol | 20.0 g |
| N,N-diethylhydroxylamine | 4.0 g |
| (N-ethyl-N-(2-methanesulphonamido)ethyl))-4-amino-3-methylbenzene-sulphate | 5.0 g |
| Potassium sulphite | 0.2 g |
| Potassium carbonate | 30.0 g |
| Polymaleic anhydride | 2.5 g |
| Hydroxyethanediphosphonic acid | 0.2 g |
| Optical brightener (4,4'-diaminostilbene type) | 2.0 g |
| Potassium bromide | 0.02 g |

make up to 1 l with water, adjust pH to 10.2 with KOH or $H_2SO_4$.

Bleach/Fixing Bath Solution

| | |
|---|---|
| Ammonium thiosulphate | 75.0 g |
| Sodium hydrogen sulphite | 13.5 g |
| Ethylenediaminetetraacetic acid (iron/ammonium salt) | 45.0 g |

make up to 1 l with water, adjust pH to 6.0 with ammonia or acetic acid.

After processing, the neutral (NK) and colour separation (FAZ) wedges are exposed to 15 million l×h and 30 million l×h of light from a xenon lamp and the percentage changes in density at densities 0.6 and 1.4 above fog are measured.

Results: see Table 1. The Example demonstrates the overall better light stability, particularly after exposure to large quantities of light (30 million l×h) when $TiO_2$ pigments are used. However, by using the $TiO_2$ pigments containing iron oxide according to the invention, this improved stability may be achieved at distinctly lower application rates or further increased if the same application rate is used.

TABLE 1

(C: comparison, I: according to the invention)

| Sample | NK | FAZ | Irradation with [mio lux · h] | % Percentage change in density at initial density: Yellow D = 0.6 | Yellow D = 1.4 | Magenta D = 0.6 | Magenta D = 1.4 | Cyan D = 0.6 | Cyan D = 1.4 |
|---|---|---|---|---|---|---|---|---|---|
| 1 (C) | x | | 15 | −33 | −21 | −40 | −19 | −39 | −22 |
| 1 (C) | x | | 30 | −62 | −44 | −82 | −41 | −71 | −46 |
| 1 (C) | | x | 15 | −39 | −24 | −49 | −27 | −41 | −23 |
| 1 (C) | | x | 30 | −71 | −49 | −90 | −57 | −74 | −48 |
| 2 (C) | x | | 15 | −28 | −16 | −35 | −17 | −21 | −13 |
| 2 (C) | x | | 30 | −49 | −30 | −65 | −31 | −40 | −23 |
| 2 (C) | | x | 15 | −31 | −18 | −42 | −24 | −24 | −14 |
| 2 (C) | | x | 30 | −54 | −33 | −70 | −42 | −43 | −25 |
| 3 (I) | x | | 15 | −29 | −16 | −34 | −16 | −21 | −14 |
| 3 (I) | x | | 30 | −48 | −31 | −66 | −31 | −41 | −24 |
| 3 (I) | | x | 15 | −32 | −20 | −43 | −22 | −23 | −14 |
| 3 (I) | | x | 30 | −53 | −33 | −69 | −41 | −45 | −26 |
| 4 (I) | x | | 15 | −22 | −13 | −29 | −13 | −16 | −10 |
| 4 (I) | x | | 30 | −40 | −27 | −57 | −26 | −29 | −19 |
| 4 (I) | | x | 15 | −24 | −16 | −31 | −14 | −17 | −10 |
| 4 (I) | | x | 30 | −50 | −29 | −60 | −29 | −40 | −20 |

We claim:

1. A color photographic silver halide material which comprises in one layer a titanium dioxide pigment containing iron oxide having an average primary particle diameter of 1 to 100 nm and an iron oxide content of 0.01 to 20 wt. %.

2. The color photographic silver halide material according to claim 1, wherein the titanium dioxide pigment has an iron oxide content of 0.05 to 10 wt. %.

3. The color photographic silver halide material according to claim 1, wherein the titanium dioxide pigment containing iron oxide has an average primary particle diameter of 5 to 50 nm.

4. The color photographic silver halide material according to claim 1, wherein the titanium dioxide is used in a quantity of 5 mg/m$^2$ to 5 g/m$^2$ of photographic material.

5. The color photographic material according to claim 1, wherein the $TiO_2$ is present in the rutile form.

6. The photographic silver halide material according to claim 1, wherein more than 90% of the primary particles have a diameter of less than 100 nm.

7. The color photographic silver halide material according to claim 3, wherein the titanium dioxide pigment has an iron content of 0.5 to 5% by weight.

8. The color photographic silver halide material according to claim 7, wherein said iron oxide is $Fe_2O_3$.

9. The color photographic silver halide print material which comprises in one layer a titanium dioxide pigment containing iron oxide having an average primary particle diameter of 1 to 100 nm and an iron oxide content of 0.01 to 20 wt. %.

10. The color photographic silver halide print material according to claim 9, wherein said titanium dioxide pigment containing iron oxide has an average primary particle diameter of 10 to 100 nm and an iron oxide content of 0.01 to 20 wt. %.

11. The color photographic silver halide material according to claim 8, wherein said $TiO_2$ pigments containing iron oxide are used in a layer which is arranged closer to a light source than the layer containing the dye to be protected.

12. The color photographic silver halide material according to claim 11, wherein the titanium dioxide is used a quantity of 100 mg/m$^2$ to 3 g/m$^2$ of photographic material.

* * * * *